United States Patent [19]

Shigenobu

[11] Patent Number: 4,541,708

[45] Date of Patent: Sep. 17, 1985

[54] HEATING-FIXING DEVICE

[75] Inventor: Michio Shigenobu, Tokyo, Japan

[73] Assignee: Canon Kabushiki Kaisha, Tokyo, Japan

[21] Appl. No.: 453,160

[22] Filed: Dec. 27, 1982

[30] Foreign Application Priority Data

Jan. 9, 1982 [JP] Japan ..... 57-1894
Sep. 30, 1982 [JP] Japan ..... 57-171904

[51] Int. Cl.[4] ..... G03G 15/20

[52] U.S. Cl. ..... 355/3 FU; 219/216; 355/14 FU

[58] Field of Search ..... 355/3 FU, 14 FU; 219/216

[56] References Cited

U.S. PATENT DOCUMENTS

| | | | |
|---|---|---|---|
| 3,202,818 | 8/1965 | Thomiszer | 219/216 X |
| 3,465,122 | 9/1969 | Kolless | 219/216 |
| 3,469,077 | 9/1969 | Petersen et al. | 219/216 X |
| 3,612,820 | 10/1971 | Punnett | 219/216 |
| 3,622,745 | 11/1971 | Shepard | 219/216 |
| 3,790,747 | 2/1974 | Klavsons et al. | 219/216 |
| 3,809,855 | 5/1974 | Neal | 219/216 |
| 4,063,066 | 12/1977 | Nagoshi | 219/216 |
| 4,395,109 | 7/1983 | Nakajima et al. | 219/216 X |

*Primary Examiner*—Fred L. Braun

*Attorney, Agent, or Firm*—Fitzpatrick, Cella, Harper & Scinto

[57] ABSTRACT

A heating-fixing device provided with a heating source emitting heat radiation, a roller having the heating source therewithin, a power source for supplying power to the heating source, and a heat-responsive member connected between the heating source and the power source. The heat-responsive member directly senses the heat radiation emitted by the heating source, whereby it quickly responds to the overheating of the heating source. A reflecting member or adiabatic member is disposed on the side of the heat-responsive member opposite the heating source for intercepting the heat which passes by the heat-responsive member.

12 Claims, 9 Drawing Figures

HEATING-FIXING DEVICE

BACKGROUND OF THE INVENTION

1. Field of the Invention

This invention relates to a heating-fixing device having a heating source emitting a heat radiation, and particularly to a heating-fixing device having the function of preventing overheating of the heating source.

2. Description of the Prior Art

Heating-fixing devices of this type have heretofore been often adopted in image formation apparatuses using the electrophotographic method, the electrostatic recording method, the magnetic photographic method or the like.

In the heating-fixing devices according to the prior art, the surface temperature of a fixing or heating roller heated by a halogen heater or the like as a heating source is detected by temperature detecting means disposed in contact with or in proximity to the fixing roller and a switch inserted in the heater circuit is opened by a temperature control circuit which has received the detection signal, whereby the surface temperature of the fixing roller is controlled so as to be maintained within an allowable range.

However, in case the opening of the switch is not effected due to failure or the like of the temperature control circuit, the fixing roller may be heated to an abnormally high temperature. Therefore, to prevent such excessive temperature rise, a temperature fuse as a heat-responsive member is provided in proximity to the fixing roller, this temperature fuse is series-inserted in the heater circuit and the temperature fuse is fused by receiving the radiant heat from the fixing roller, thereby preventing excessive temperature rise of the fixing roller.

In this case, it is for the following reason that the temperature fuse is disposed in proximity to the fixing roller with a predetermined distance maintained therefrom as described above. Between the fixing roller and the temperature fuse, there is a regular temperature relation depending on the distance. For example, if the surface temperature of the fixing roller is 200° C., then the temperature at a distance of 1 mm from the fixing roller is 180° C., the temperature at a distance of 2 mm from the fixing roller is 160° C., the temperature at a distance of 3 mm from the fixing roller is 130° C., and the temperature at a distance of 4 mm from the fixing roller is 90° C. Accordingly, if a temperature fuse of rated temperature (the temperature at which fusing occurs) 168° C. is disposed, for example, at a distance of 2 mm from the fixing roller, it does not fuse when the surface temperature of the fixing roller is controlled normally within an allowed range, and during abnormality, namely, due to failure or the like of the temperature control circuit, the temperature of the fixing roller rises excessively and the temperature at the position whereat the temperature fuse is disposed reaches 168° C. or higher, whereby the temperature fuse fuses and the supply of power to the heating source can be cut off reliably. However, if the temperature fuse is provided at a position proximate to the fixing roller as described above but spaced apart from the peripheral surface of the fixing roller, the temperature fuse is subject to the influence of the air stream around the roller and the fuse and there may occur the inconvenience that the fuse does not fuse in spite of the fixing roller having actually reached a dangerous temperature, and the amount of heat radiation which the temperature fuse receives from the fixing roller considerably differs if the distance from the roller slightly differs, and thus high accuracy of the position at which the fuse is disposed has been required. Further, with only the radiant heat from the roller, where a temperature fuse which directly controls a heavy current is employed, its heat capacity is great and the time from when the roller has reached an abnormal temperature until the fuse is fused, namely, the response time, is long, and this has led to the problem that temperature rise of the roller progresses in the meantime, and this problem has been particularly serious to a roller of small wall thickness and small heat capacity.

SUMMARY OF THE INVENTION

It is an object of the present invention to overcome the above-noted disadvantages peculiar to the prior art and to provide a heating-fixing device which can achieve improved heat responsiveness and has the overheat preventing function of preventing the overheating of a heating source in which temperature change is abrupt.

The present invention which achieves the above object is a heating-fixing device in which a heat-responsive member is disposed at a position whereat the heat radiation emitted by the heating source can be directly sensed.

The above and other objects and features of the present invention will become more fully apparent from the following detailed description taken in conjunction with the accompanying drawings.

DESCRIPTION OF THE PREFERRED EMBODIMENTS

Figure 1:
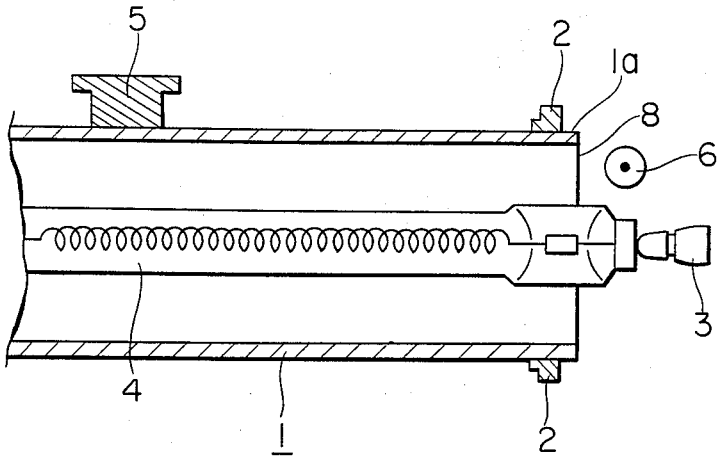
FIGS. 1 and 2 are side cross-sectional views of a fixing roller using an embodiment of the present invention.
Figure 2:
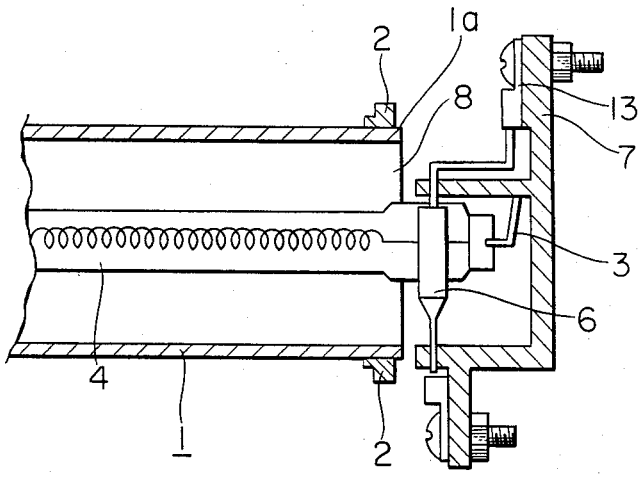

FIGS. 1 and 2 are side cross-sectional views of a heating-fixing roller to which an embodiment of the present invention is applied.

Figure 3:
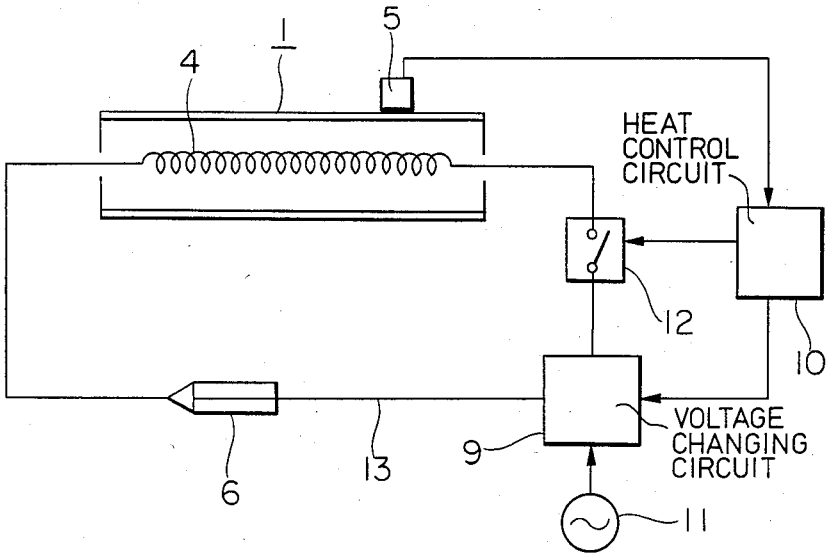
FIG. 3 is a block diagram of a temperature control circuit of the roller.

In these Figures, reference numeral 1 designates a fixing roller which is a cylinder formed of aluminum. This fixing roller 1 has its opposite ends (only one of which is shown) rotatably held by bearings 2. A halogen heater 4 is provided within the roller 1 over the full width thereof. This halogen heater 4 is supported substantially centrally of the roller 1 by an electrode 3 attached to a frame member 7 and is electrically connected to a power source through the electrode 3. A temperature detecting means 5 such as a thermistor is provided in contact with or in proximity to the surface of the roller 1 to maintain and control the temperature of the roller 1 within a temperature range capable of fixing a toner image, and detects the surface temperature of the roller 1. A temperature fuse 6 as a heat-responsive member is disposed at a position whereat it can directly sense the heat radiation emitted by the halogen heater 4. In the present embodiment, the fuse 6 is provided so as to directly receive the heat radiation exiting outwardly of the roller 1 through an opening 8 in the end portion of the roller 1. The fuse 6 is series-connected between the heater 4 and a power source 11 through a lead wire 13 attached to the frame member 7 (FIG. 3).

Temperature control of the roller 1 will now be described by reference to FIG. 3.

The fixing roller 1 is heated by the heater 4 supported by the electrode 3. The conducted heat or radiant heat from the fixing roller 1 is detected by the thermistor 5 as the temperature detecting means disposed in contact with or in proximity to the surface of the fixing roller 1. In accordance with the detected temperature, a switch 12 is closed or opened by a signal from a heat control circuit 10, thereby controlling the surface of the roller 1 so that it is maintained within a suitable temperature range necessary for fixation of the toner image. At this time, the temperature control circuit 10 controls a changing circuit 9 for changing the output voltage from the power source 11 and increases the voltage applied to the halogen heater 4 when the surface temperature of the roller 1 is raised from room temperature to a temperature necessary for fixation, thereby controlling the heater 4 so as to put out a maximum rated output, and decreases the voltage applied to the heater 4 once the surface temperature of the roller 1 reaches the temperature necessary for fixation, thereby controlling the heater 4 so as to put out ½ of said output.

Should the fixing roller 1 be heated to a level above a predetermined temperature, the temperature fuse 6 directly receives the heat above this rated temperature and fuses. If the fuse 6 fuses by heat, the supply of power to the heater 4 will be immediately discontinued because the fuse 6 is series-connected between the heater 4 and the power source 11. At this time, particularly the fuse 6 can fuse quickly in response to the excessive heating of the heater 4 to thereby quickly eliminate the abnormal condition because the fuse is provided at a position whereat it directly receives the heat radiation from the heater.

Figure 4:
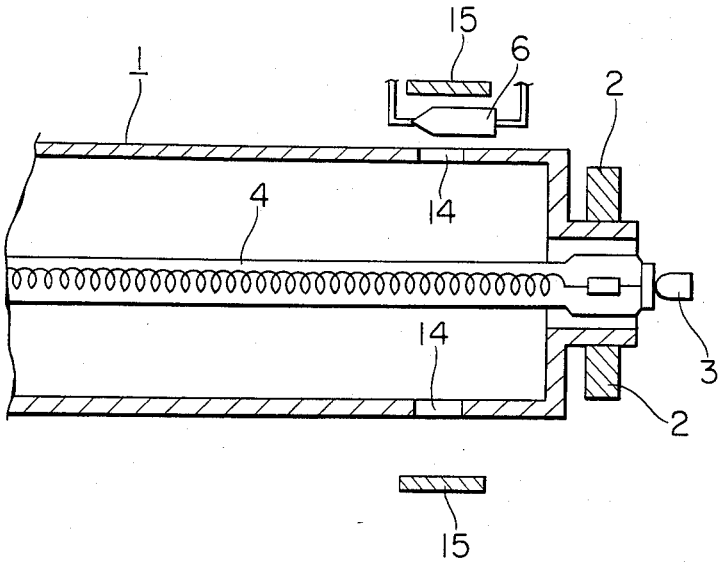
FIG. 4 is a side cross-sectional view of a fixing roller showing another embodiment of the present invention.

Another embodiment of the present invention is shown in FIG. 4. In this embodiment, openings 14 are formed in a portion of the peripheral surface of a fixing roller 1 which is not traversed by paper and a fuse 6 is disposed on the outer side of the roller 1 which is opposed to the openings 14. Again by this embodiment, the heat radiation from the heater 4 can be directly sensed through the openings 14. In the case of the present embodiment, an adiabatic member 15 may be provided along the openings 14 so as to prevent the heat from the opening 14 from leaking outwardly, whereby the heat responsiveness of the fuse can be enhanced.

Figure 5:
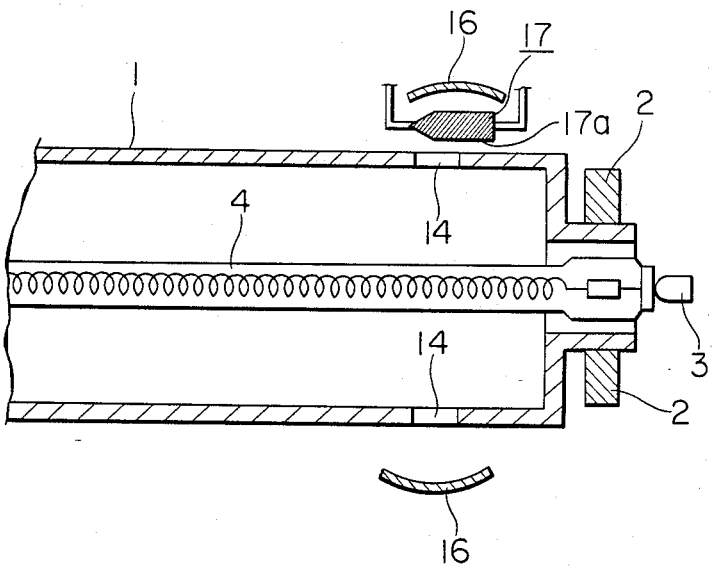
FIG. 5 is a side cross-sectional view of a fixing roller showing still another embodiment of the present invention.

FIG. 5 shows a further embodiment of the present invention. As shown, this embodiment uses a fuse 17 fully painted in black, instead of the fuse shown in FIG. 4. The fuse 17 is coated with a heat-resistant and non-lustrous black coating material 17*a* (for example, "Tetsuzole" (trade name) produced by Nitto Kogyo Co., Ltd.). By this, the heat absorption efficiency can be increased. If, moreover, a reflector 16 for reflecting toward the fuse the heat radiation which passes by the fuse is provided on the opposite side of the fuse 17 with respect to the heater 4, the heat responsiveness of the fuse 17 can be further enhanced.

Of course, the temperature fuse coated with the black coating material as described above is applicable to the embodiments shown in FIGS. 1, 2 and 4, and said reflector 16 may be provided over the fuse disposed at the position whereat it directly senses the heat radiation exiting outwardly of the roller through the opening in the end portion of the roller, as shown in FIGS. 1 and 2, and the heat responsiveness may be enhanced by such reflector surrounding the fuse. The coating of the fuse is not limited to the black coating material as used in the present embodiment, but may be, for example, a heat-absorbent substance.

Again in case the fuse is disposed at a position whereat it directly receives the heat radiation exiting outwardly of the roller through the opening in the end portion of the roller as shown in FIGS. 1 and 2, such an adiabatic member as mentioned previously may be provided and, if an adiabatic member is used for the frame member 7, leakage of heat can be prevented more effectively.

Figure 6:
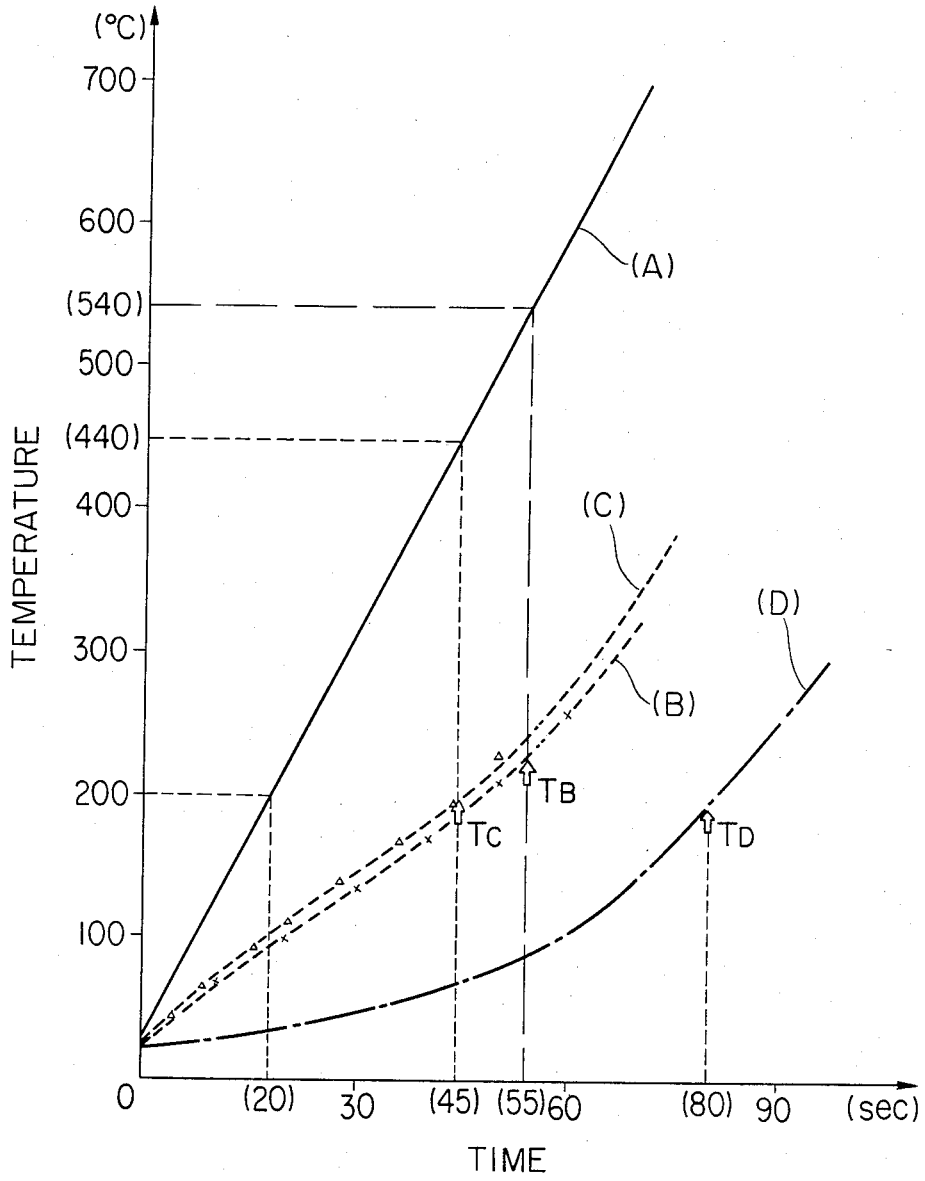
FIG. 6 is a graph showing the result of an experiment in which the embodiments of the present invention were compared with an example of the prior art.

FIG. 6 shows the result of an experiment in which the heat responsiveness of the embodiments of the present invention was compared with that of the example of the prior art.

First, in the embodiment shown in FIGS. 1 and 2, an experiment was carried out by the use of a fixing roller of aluminum having a wall thickness of 2 mm within which a halogen heater of 1.2 kw was disposed. When an AC voltage of 100 v was applied to this halogen heater and the fixing roller was heated by an output of 1.2 kw, the surface temperature of the roller rose with time as indicated by straight line (A) in FIG. 6, for example, rose to 200° C. in about 20 seconds.

When a high precision temperature fuse of rated temperature (fusing temperature) 196° C.±1.67° C. was series-connected to the halogen heater and by supposing abnormality, an experiment was carried out in which power continued to be supplied to the halogen heater, the fuse fused in about 55 seconds (as indicated by $T_B$ in FIG. 6) and the supply of power to the halogen heater was cut off. At this time, the surface temperature of the fixing roller momentarily reached about 540° C. but the fixing roller did not melt. Curve (B) in FIG. 6 indicates the relation between the heating time and the ambient temperature around the fuse in the embodiment shown in FIGS. 1 and 2.

The result of the experiment in case a black-painted fuse was used is indicated by curve (C). When the experiment was carried out by the use of temperature fuse of the same rated temperature, the fuse fused in about 45 seconds (as indicated by $T_C$ in FIG. 6). When this is compared with the case of temperature fuse not black-painted (curve (B)), it is seen that the temperature fuse mentioned just above fused about 10 seconds earlier under the same conditions, and the supply of power could be cut off in a condition in which the surface temperature of the fixing roller was about 100° C. lower than that in case the temperature fuse was not painted in black.

Also, when experiment was carried out regarding a case where the radiant heat from the roller is received by temperature fuse provided at a distance of 4 mm from the surface of the roller to detect any variation in surface temperature of the conventional roller, the relation between time and the ambient temperature around the fuse became as indicated by curve (D) and about 80 seconds was required before the temperature fuse of 139° C.±1.67° C. rating fused (as indicated by $T_D$ in FIG. 6) and by this time, the fixing roller of aluminum had already melted and degenerated. With the temperature fuse of 139° C.±1.67° C. rating, when it was placed near the fixing roller of about 200° C. for a long time, the ambient temperature rose and the temperature fuse fused in the regular condition of use and therefore, it was necessary to use a further higher temperature of 169° C. as the rating. That is, the fusing of temperature fuse can be quickened by painting the temperature fuse in black and it is seen that the present embodiment has heat responsiveness remarkably improved as compared with the prior art.

Figure 7:
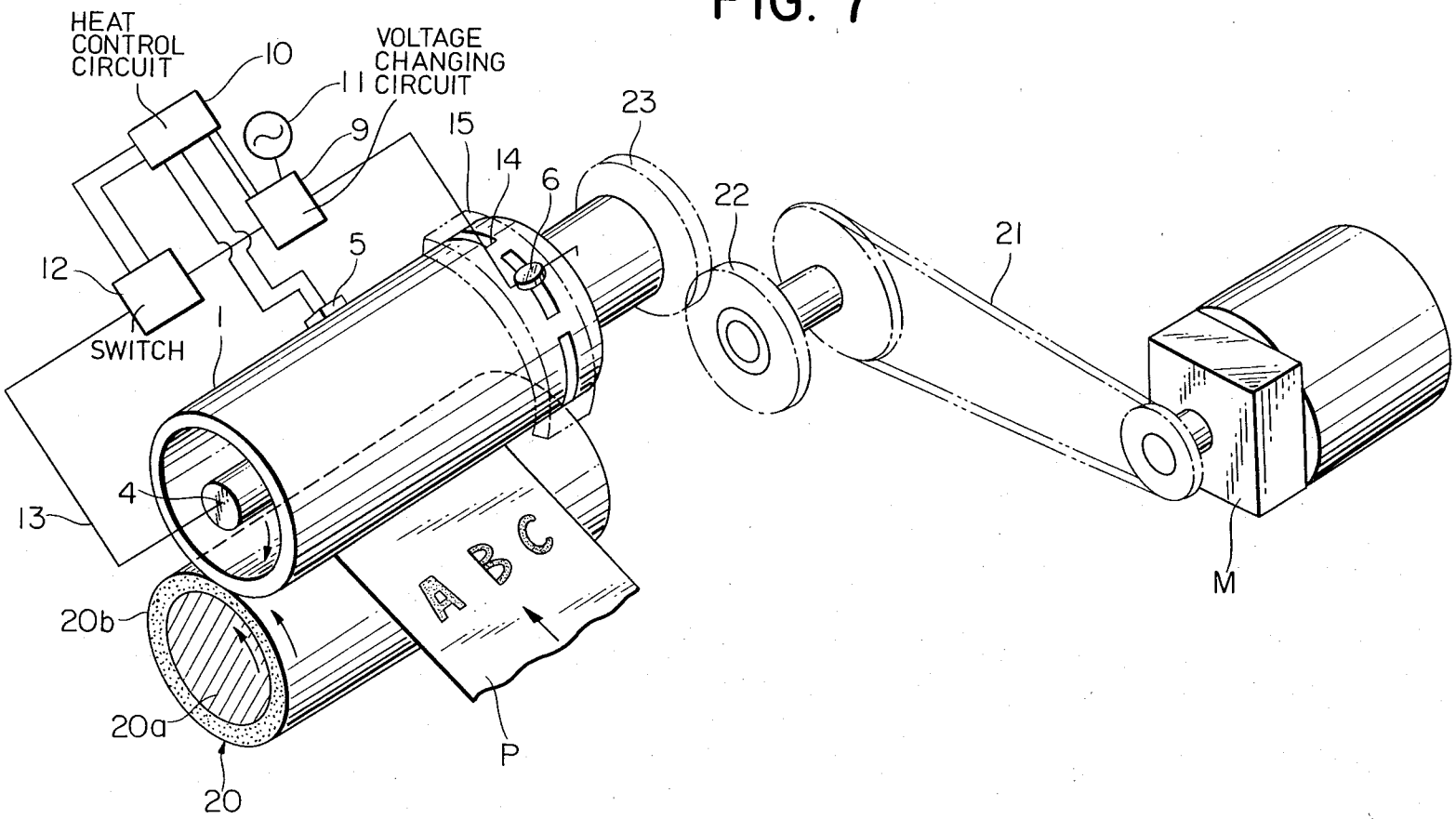
FIG. 7 is a schematic view showing an example of the entire fixing device.

FIG. 7 shows an example of the fixing device using an embodiment of the present invention. In FIG. 7, reference numeral 20 designates a pressing roller comprising a mandrel 20*a* having its peripheral surface covered with an elastic member 20*b* such as silicone rubber. The fixing roller 1 is rotated by the drive force from a motor M which is transmitted to the roller 1 by chain 21 and gears 22, 23, and the pressing roller 20 follows the rotation of the fixing roller 1. Alternatively, the drive force from the motor M may be transmitted to the pressing roller 20. A sheet P having an unfixed toner image thereon is held and conveyed between the fixing roller 1 and the pressing roller 20 rotated while being urged against each other, whereby the unfixed toner image is fixed on the sheet P by the heat from the heater 4. In FIG. 7, showing of the device frame and bearings is omitted. As shown, temperature fuse 6 is disposed in opposed relationship with openings 14 formed in the portion of the peripheral surface of the fixing roller which is not traversed by the paper, and an adiabatic member 15 is provided along the openings 14 to prevent heat from leaking to the outside. By the temperature fuse being thus disposed at a position whereat it can directly sense the heat radiation emitted from the heater 4, unlike the conventional method in which the roller is once heated and the radiant heat thereof is detected, the temperature fuse can quickly fuse to cut off the supply of power to the heater when the heater heats up excessively.

Figure 8:
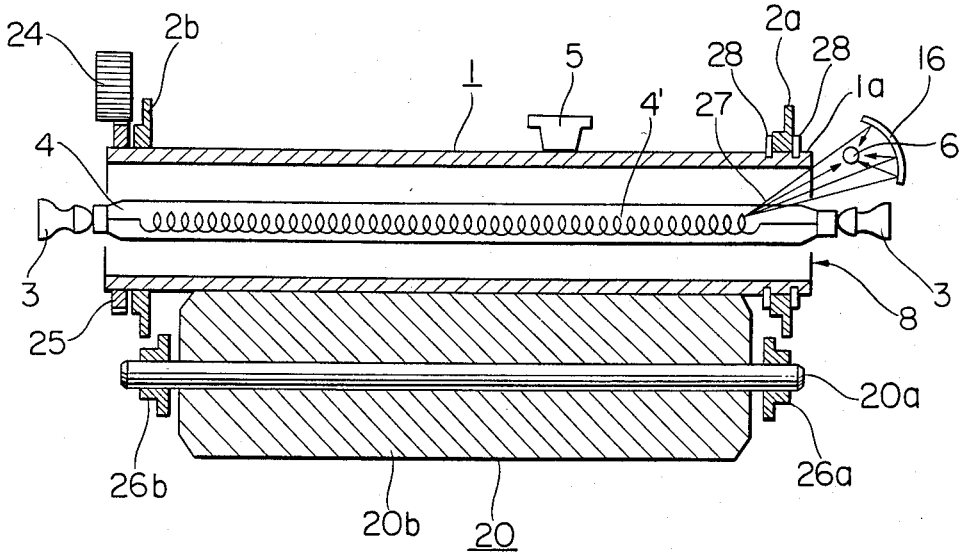
FIG. 8 is a cross-sectional view of the fixing device showing still another embodiment of the present invention.
Figure 9:
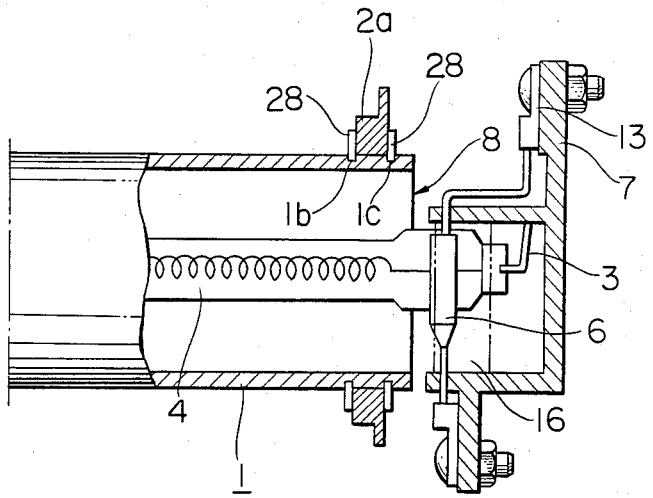
FIG. 9 is a fragmentary cross-sectional view of the fixing roller in FIG. 8.

FIGS. 8 and 9 show a further embodiment of the present invention. The fixing roller 1 is a thin-walled roller made of aluminum and the opposite ends thereof are rotatably held by bearings 2*a* and 2*b* as shown in FIG. 8. A thin layer of tetrafluoroethylene resin or silicone rubber may be applied to the peripheral surface area of the fixing roller 1 which is urged against a pressing roller 20, to prevent offset. The bearings 2*a* and 2*b* are mounted on the support frame (not shown) of the fixing device. A drive gear 25 is fitted and fixed to the fixing roller 1 and the drive force from a drive source (not shown) on the copying apparatus body side is transmitted through a gear 24 on the body side. The pressing roller 20 follows the rotation of the fixing roller 1. The pressing roller 20 against which the fixing roller 1 is urged comprises a mandrel 20*a* of stainless steel having the peripheral surface thereof covered with an elastic member 20*b* such as silicone rubber. The mandrel 20*a* is rotatably supported by bearings 26*a* and 26*b*. A halogen heater 4 is provided within the fixing roller 1 substantially over the full length thereof. This halogen heater 4 is supported substantially centrally of the roller 1 by electrodes 3 attached to a frame member 7 and is electrically connected to a power source through the electrodes 3. Thus, the roller 1 is heated from therewithin by the heat radiation emitted by the filament 4' of the heater 4. A sheet having an unfixed toner image hereon is held and conveyed between the fixing roller 1 and the pressing roller 20 rotated while being urged against each other, whereby the unfixed toner image is heated and fixed on the sheet.

Now, as is apparent from FIG. 8, fuse 6 is disposed in proximity to the end of the roller 1 so as to directly receive the heat radiation 27 exiting from the opening 8 in one end 1*a* of the roller 1, of the radiant heat of the filament 4' of the heater 4. Behind the fuse 6, there is disposed a reflector 16 for reflecting said heat radiation which has passed by the fuse 6 and directing it to the fuse 6. This reflector 16 may be eliminated, but by providing it, as described in connection with the previous embodiment, the amount of heat radiation from the heater 4 imparted to the fuse 6 can be increased to reduce the response time of the fuse 6 during abnormality. Also, as in the previously described embodiment, the fuse may be coated with a black coating material to thereby enhance the heat absorption. In any case, the fuse 6 is heated by the heat radiation from the heater 4 and therefore, as compared with the fuse heated by the radiant heat of the roller 1, the fuse 6 is small in influence of the ambient air stream and its response time becomes short, so that the fuse 6 responds faithfully to any abnormal condition as previously described.

On the other hand, the roller 1 is constructed chiefly of a metal material such as aluminum having a great coefficient of thermal expansion and therefore, when heated by the heater 4, the roller 1 expands axially thereof due to thermal expansion. At that time, when the position of the end of the opening in the roller to which the fuse 6 is opposed is displaced rightwardly as viewed in FIGS. 8 and 9, the rate at which the roller end kicks the heat radiation relative to the fuse 6 increases and the responsiveness to abnormal condition becomes blunt. Therefore, as shown in FIGS. 8 and 9, grooves 1*b* and 1*c* are formed in that side of the roller 1 on which the fuse 6 is disposed, and C-rings 28, 28 are fitted into these grooves so that the bearing 2*a* is held by and between these C-rings 28, 28. Accordingly, the roller end portion is hardly moved axially of the roller. (This amount of movement is determined by the gap between the bearing 2*a* and the C-rings 28, 28, and it is easy to limit it usually to the accuracy of the order of ±0.1 mm.) On the other hand, the bearing 2*b* supporting the other end portion of the roller 1 is a plain bearing which rotatably supports the roller 1 and also axially movably supports the roller 1. Consequently, after the roller 1 has begun its thermal expansion, that end portion of the roller 1 on which the fuse 6 is not provided, i.e., that end portion of the roller 1 to which the gear 25 is secured, is displaced leftwardly as viewed in FIG. 8, while the end portion 1*a* which is adjacent to the opening is hardly displaced rightwardly. Accordingly, even when the roller 1 thermally expands and its length is prolonged, there occurs no inconvenience that the rate at which the roller end kicks the heat radiation from the heater 4 relative to the fuse 6 increases. Consequently, accurate operation becomes possible.

The end portion which is adjacent to the gear 25 is displaced leftwardly due to thermal expansion and therefore, it is desirable that the width of the gear 24 which is in mesh engagement with the gear 25 be enough for sufficient mesh engagement to be maintained even if the gear 25 is so displaced.

Although, in the above-described embodiment, the end portion 1*a* which is adjacent to the opening 8 is fixedly supported with respect to the axial direction of the roller by the use of the C-rings 28, 28 the C-rings may be eliminated and balls may be interposed between the inner race and the outer race of the bearing 2*a* to replace it by a ball bearing in which there is very little back-lash in the axial direction between the inner race and the outer race, and the roller 1 may be forced into and fixed to the inner race, while the outer race may be fixed to the body frame of the fixing device, whereby the end portion 1*a* which is adjacent to the opening 8 may be prevented from being moved with respect to the axial direction of the roller, that is, may be fixedly supported. On the other hand, the roller end portion opposite to the opening 8 is freely supported with respect to the axial direction of the roller by the plain bearing 2*b*, that is, movably supported with respect to the axial direction of the roller, but such a ball bearing as described above can also be used as the bearing 2*b* and in that case, the inner race and the roller 1 may be fixed to each other with respect to the direction of rotation of the roller by a key, and a key groove may be provided axially of the roller, whereby the roller end portion may be made movable with respect to the axial direction of the roller relative to the inner race. The outer race may be fixed to the body frame of the fixing device.

In the above-described embodiment, aluminum which has a great coefficient of linear expansion is used as the material of the fixing roller, but metals such as iron, stainless steel, copper, brass, etc. may also be utilized.

In the present embodiment, a power of 1.2 kw is supplied at full wave during wait-up and the output voltage from the power source is phase-controlled during copying or stand-by so as to supply a power of about 700 W or the heating amount of the heater is made small by intermittent power supply and therefore, the amount of heat radiation emitted from the same heater differs greatly between wait-up and copying or stand-by and usually, the temperature fuse does not fuse. Further, even in case the temperature control circuit, etc. fail while being phase-controlled and the heater continues to be turned on and emits a high heat, the fuse can be fused in the same degree of time as that in the case where phase-control is not effected, for the small heating amount in the case where phase-control is effected, in spite of the fact that the amount of heat emitted from the same heater differs greatly between the case where phase-control is not effected and the case where phase-control is effected, because the fuse is disposed at a position whereat it directly receives the heat radiation emitted by the heater.

Accordingly, even in a case where the heating amount is reduced except for a special case such as wait-up by controlling the heating amount of the heater to permit normal use, it is effective to dispose the fuse at a position whereat it directly senses the heat radiation emitted by the heater.

While, in each of the above-described embodiments, only an example in which fuse capable of fusing by heat is used as the heat-responsive member has been shown, other various devices such as, for example, a bimetal type temperature switch, a magnetic type temperature switch, a thermistor and the like may also be utilized.

As described above, the present invention, when an abnormal situation has occurred and the temperatures of the fixing roller and the various members around it have risen abnormally, can quickly respond thereto and cut off the supply of power to the heating source, thereby enhancing the safety.

I claim:

1. A heating-fixing device comprising a heating source for emitting heat radiation, a heating roller having said heating source therewithin, a pressing roller for pressing a toner image bearing medium against said heating roller, a power source for supplying power to said heating source, temperature detecting means for detecting the temperature of the surface of said heating roller, a temperature control circuit for controlling the temperature of the surface of said heating roller in accordance with the detected temperature, a heat-responsive member connected between said heating source and said power source, said heat-responsive member being disposed at a position whereat it directly receives the heat radiation emitted by said heating source, and a reflecting member for reflecting the heat radiation which passes by said heat-responsive member back toward said heat-responsive member, said reflecting member being provided on the side of said heat-responsive member opposite to said heating source, wherein when the temperature of said heat-responsive member goes above a predetermined temperature, said heat-responsive member causes the supply of power from said power source to said heating source to be cut off.

2. A heating-fixing device comprising a heating source for emitting heat radiation, a heating roller having said heating source therewithin, a pressing roller for pressing a toner image bearing medium against said heating roller, a power source for supplying power to said heating source, temperature detecting means for detecting the temperature of the surface of said heating roller, a temperature control circuit for controlling the temperature of the surface of said heating roller in accordance with the detected temperature, a heat-responsive member connected between said heating source and said power source, said heat-responsive member being disposed at a position whereat it directly receives the heat radiation emitted by said heating source, and an adiabatic member for intercepting the leakage of heat provided on that side of said heat-responsive member which is opposite to said heating source, wherein when the temperature of said heat-responsive member goes above a predetermined temperature, said heat-responsive member causes the supply of power from said power source to said heating source to be cut off.

3. A heating-fixing device according to claim 1 or 2, wherein said heating roller is provided with an opening at one end through which said heating source is inserted and wherein said heat-responsive member is disposed outside said roller so as to directly receive the heat radiation exiting out of said roller through said opening.

4. A heating-fixing device according to claim 1 or 2, wherein said heat-responsive member is a fuse adapted to be fused by heat when said heating source overheats, thereby cutting off the supply of power from said power source.

5. A heating-fixing device according to claim 4, wherein said fuse is coated with a heat-absorbent substance.

6. A heating-fixing device according to claim 1 or 2, wherein said heating roller is provided with an opening on its peripheral surface at a location outside the path of the toner image bearing medium through which heat radiation may exit, and wherein said heat-responsive member is disposed in opposed relationship with said opening and outside said heating roller.

7. A heating-fixing device according to claim 6, wherein said heat-responsive member is a fuse adapted to be fused by heat when said heating source overheats, thereby cutting off the supply of power from a power source.

8. A heating-fixing device according to claim 7, wherein said fuse is coated with a heat-absorbent substance.

9. A heating-fixing device comprising a heating source for emitting heat radiation, a heating roller open at one end and having said heating source therewithin, a pressing roller for pressing a toner image bearing medium against said heating roller, a heat-responsive member responsive to an abnormal temperature rise to cut off a supply of power to said heating source, means for disposing said heat-responsive member at a position whereat it receives the heat radiation from said heating source exiting through the open end of said heating roller, first support means for fixedly supporting the open end of said heating roller with respect to the axial direction thereof, second support means for freely supporting the opposite end portion of said roller with respect to the axial direction of said heating roller, and a reflecting member for reflecting the heat radiation which passes by said heat-responsive member back toward said heat-responsive member, said reflecting member being provided on the side of said heat-responsive member which is opposite to said heating source.

10. A heating-fixing device according to claim 9, wherein said heat-responsive member is a fuse adapted to be fused by heat when said heating source overheats, thereby cutting off the supply of power from a power source.

11. A heating-fixing device according to claim 10, wherein said fuse is coated with a heat-absorbent substance.

12. A heating-fixing device according to claim 9, further comprising temperature detecting means for detecting the temperature of the surface of said heating roller, and a temperature control circuit for controlling the temperature of the surface of said roller in accordance with the detected temperature.

* * * * *